United States Patent [19]

Sterlini

[11] 4,187,899

[45] Feb. 12, 1980

[54] METHOD AND APPARATUS FOR EXCHANGING HEAT BETWEEN FLUIDS

[75] Inventor: Jacques Sterlini, Paris, France

[73] Assignee: CEM-Compagnie Electro-Mecanique, Paris, France

[21] Appl. No.: 884,125

[22] Filed: Mar. 7, 1978

[30] Foreign Application Priority Data

Mar. 9, 1977 [FR] France ..... 77 07041

[51] Int. Cl.[2] ..... F28C 3/08; F25B 7/00; F25B 1/10

[52] U.S. Cl. ..... 165/1; 62/79; 62/335; 62/510

[58] Field of Search ..... 62/79, 115, 335, 510; 165/1

[56] References Cited

U.S. PATENT DOCUMENTS

| | | | |
|---|---|---|---|
| 3,092,976 | 6/1963 | Hashemi-Tafreshi | 62/117 |
| 3,306,346 | 2/1967 | Othmer | 165/1 |
| 3,954,430 | 5/1976 | Curtis et al. | 62/510 |
| 4,019,343 | 4/1977 | Roberts | 62/510 |
| 4,149,585 | 4/1979 | Sterlini | 165/1 |

*Primary Examiner*—Lloyd L. King

*Attorney, Agent, or Firm*—Burns, Doane, Swecker & Mathis

[57] ABSTRACT

A method and apparatus for exchanging heat between a plurality of circuits carrying fluids at different temperatures ranging from $T_o$ to $T_N$ includes at least one adjustable heat-carrying circuit for balancing the overall thermodynamic equilibrium of the heat exchanges. Each stage of a plurality of stages operates over one of the temperature intervals $T_o$ to $T_1$, $T_1$ to $T_2$, . . . , $T_{N-1}$ to $T_N$, and includes at least one cell filled with a transfer fluid as both a liquid and a vapor. The vapor is transferred between cells of adjacent stages by compressors and by turbines. The liquid is transferred between cells of adjacent stages by pumps and by conduits having calibrated orifices. The adjustable heat-carrying circuit may either supply or remove heat and may extend through either a single cell or a plurality of adjacent cells.

24 Claims, 10 Drawing Figures

METHOD AND APPARATUS FOR EXCHANGING HEAT BETWEEN FLUIDS

BACKGROUND AND SUMMARY OF THE INVENTION

The invention relates generally to a method and apparatus for providing heat exchanges between fluids. More particularly, the invention concerns a method and apparatus for transferring heat between diverse working fluid circuits in a manner having maximum reversibility and which is independent of characteristics of the transfer mode. The diverse working fluid circuits each circulate a fluid which may add or substract heat both while the fluid is maintained at a constant temperature, as for example in boilers or condensers, or while the fluid is undergoing a discrete temperature change, for example in circuits involving temperature dependent heat.

A heat-exchange process between fluids is already known in which a working fluid circuit receives heat from the latent heat of a low-pressure condensing vapor that is at an elevated temperature. Such a process and a heat-pump for implementation of the process are described in the applicant's French patent application No. 75 11.438. In the heat pump, a multi-stage compressor has an intake stage for a primary fluid which is in the form of a saturating vapor. Each stage of the compressor and its associated cell constitutes one module. The cells are arranged in series and communicate with each other through orifices which are calibrated at the level of the primary fluid condensate. A plurality of cooling-condensation heat exchange cores are located in a corresponding plurality of subsequent cells with the plurality of cores being associated at least with the highest pressure cells in the amount of one core per cell. In addition, means for introducing a secondary fluid into the first core of the plurality of cores is provided. Means is also provided for evacuating the secondary fluid from the core of the last cell associated with the highest pressure stage. Finally, means is provided for evacuating the primary fluid at the level of the first cell in the wholly liquid state.

Another heat exchange process is described in the applicant's French patent application No. 76 14.965 of May 18, 1976, entitled "Inter-Fluid Heat-Exchanging Process & Equipment." In this process, means is provided by which heat fed by a first fluid is used to change a second fluid from a liquid state to a saturated vapor state. The process of that invention is particularly applicable when low-level, temperature dependent heat is available in a liquid, for example a geothermal brine, and where it is desired to transfer the temperature dependent heat to another liquid such as fresh water by raising the temperature of the other liquid. In this process, if a liquid at temperature $T_1$ is available, the temperature of the liquid is lowered to $T_o$. The heat released during this reduction in temperature is used to heat another liquid from a temperature $T_2$ to a temperature $T_3$, with the average of the temperatures $T_2$ and $T_3$ being higher than the average of temperatures $T_o$ and $T_1$. In such a case, three fluids are used, for example geothermal brine, ammonia, and fresh water with the invention being applicable both when $T_o<T_1<_2<T_3$ and when $T_o<T_2<T_1<T_3$.

An object of the present invention is to provide an exchange of heat between a plurality of predetermined heat-carrying circuits in the temperature range $T_o$ to $T_N$. When the heat exchanges between the circuits are unbalanced, it is possible to re-establish balance by adding a minimum amount of complementary heat to the system with minimum work.

Another object of the present invention is to provide a method and apparatus for heat-exchange between a plurality of heat-carrying circuits at temperature levels ranging from $T_o$ to $T_N$ for the purpose of balancing the respective temperatures of the circuits while expanding a minimum of heat and of work.

An apparatus according to the present invention includes a plurality of compressor systems and turbine systems. Each compressor and turbine system operates within one of a plurality of bounded temperature intervals from $T_o$ to $T_1$, $T_1$ to $T_2$, . . . , $T_{N-1}$ to $T_N$, covering the entire range from $T_o$ to $T_N$.

Each compressor system includes a plurality of series-arranged stages with each stage having a compressor and a cell which is filled with a fluid, designated with transfer fluid. The transfer fluid is present in both liquid and vapor phases in each cell. In general, each cell further includes at least one calibrated orifice through which the transfer fluid arrives in liquid form from an adjacent stage of next higher rank and a liquid exhaust conduit communicating with an adjacent stage of next lower rank. In addition the cell has at least one vapor exhaust conduit communicating with the adjacent stage of next higher rank and a vapor inlet communicating through the stage compressor with the adjacent stage of next lower rank. All of the cells are ranked and arranged in series according to increasing vapor pressure (i.e. temperature). The cells may be crossed by one or more working fluid circuits. The working fluid circuit may carry temperature dependent heat and may pass serially through several successive stages. Other working fluid circuits may carry latent heat in a manner related to the particular stage under consideration. The first rank stage includes neither a compressor nor a liquid exhaust whereas the highest-rank stage includes neither a vapor outlet nor a liquid intake with associated orifice.

Each turbine system includes a plurality of serially arranged stages with each stage including a turbine, a pump and a cell. Each cell is filled with the transfer fluid in both liquid and vapor form and includes, in general, at least one orifice for receiving the vapor from an adjacent cell of next higher rank via the turbine, a liquid exhaust for evacuating the liquid by means of the pump towards the adjacent stage of next higher rank, and conduits for evacuating the vapor toward the adjacent stage of next lower rank and receiving liquid from the adjacent stage of next lower rank. The cells are arranged in series in the order of increasing vapor pressure and temperature, with the cells being crossed by the working fluid circuits both for temperature dependent heat and for latent heat. The first-rank stage includes neither a vapor outlet nor a liquid intake nor a pump, while the highest-ranking stage includes neither a vapor intake nor a liquid exhaust nor a turbine.

The compressor and turbine systems are mechanically and thermodynamically coupled together to form the overall apparatus, with communication being established between the atmospheres of the adjacent cells of two adjacent systems operating with the same working fluid. A thermodynamic equilibrium of the equipment is achieved by providing adjustable properties for at least one additional heat-exchanging circuit. The additional heat-exchanging circuit may include a valve and a heat exchange core which crosses at least one cell.

In addition, the mechanical coupling for the turbines and compressors of the equipment may include a motor for starting the apparatus and for supplying additional energy or for removing excess energy. In the apparatus, the cells of adjacent stages of two pluralities of stages of systems of different kinds may be joined so as to obtain a single cell per stage.

BRIEF DESCRIPTION OF THE DRAWINGS

In order that the invention may be more readily understood, reference is made to the accompanying drawings, in which like numerals refer to like members and wherein.

DETAILED DESCRIPTION OF THE PREFERRED EMBODIMENT

With reference to FIGS. 1 through 5, the heat exchange apparatus used in the process disclosed in French patent application Fr 76 14.965 includes a sequence of pressure and temperature stages. A fluid, which shall be denoted here as the transfer fluid, provides a medium for exchanging heat between a vapor condensing in the presence of its liquid and between temperature dependent working fluids which circulate in the heat exchange cores and pass in series through the cells. Each cell is fed an amount of transfer fluid vapor by means of a compressor from the preceding cell which is at a lower pressure and temperature. Each cell also transmits to the same preceding cell at the lower pressure precisely the same amount of liquid by means of a calibrated orifice. The three streams, the vapor stream, the liquid stream and the heat-carrying fluid, reach thermodynamic equilibrium by contact with one another as they pass through the cell.

The flow of working fluid from the adjacent cell takes on the temperature of the cell being considered, which temperature is the saturation temperature for the pressure of that cell since the bulk of the transfer fluid is in the form of liquid. If the working fluid comes from the next preceding cell (i.e., lower rank) which is at a lower pressure and temperature, the working fluid removes heat from the cell, causing the cell to be cooled. If, on the other hand, the working fluid comes from the next following cell (i.e., higher rank) which is at a higher pressure and temperature, the fluid releases heat to the cell, causing the cell to be heated.

Transfer fluid in the liquid phase comes from the next higher cell with higher pressure and temperature and flashes through the orifice when reaching the present cell. That is, the liquid instantaneously converts into vapor. Transfer fluid in the vapor phase issues from the compressor and arrives in a superheated condition at the cell and becomes a saturated vapor in the presence of the liquid phase.

The enthalpy balance of the cell give rise to either vaporization or condensation of the transfer fluid. In vaporization, the liquid flow of the transfer fluid descending to the preceding cell with lower pressure and temperature decreases; and, the flow of the vapor ascending to the following cell with higher pressure and temperature increases. In condensation, the liquid flow of the transfer fluid descending to the preceding cell with lower pressure and temperature increases; and, the flow of the vapor ascending to the following cell with higher pressure and temperature decreases. By definition the cell rank increases from low pressures and temperatures towards high pressures and temperatures, with the rank being denoted from 1 to n for n temperature intervals.

Figure 1:
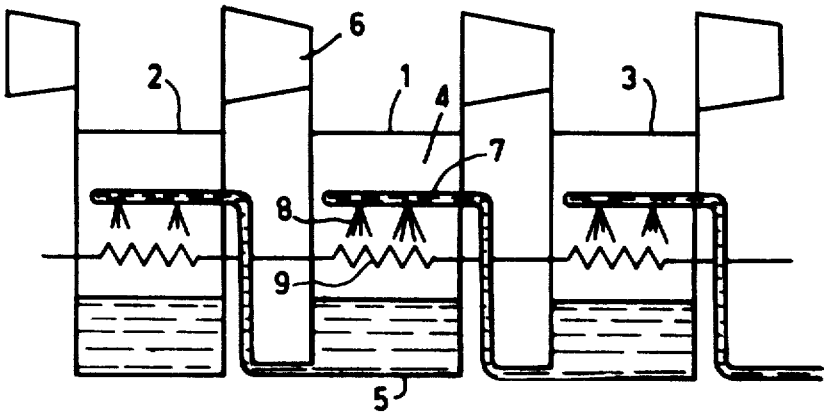
FIG. 1 is a schematic illustration of a series of compressor stages.

With reference now to FIG. 1, a schematic of a known apparatus includes an intermediate stage 1 which is connected with two neighboring stages 2 and 3. The intermediate stage 1 includes a cell which is filled in its upper part 4 with a saturated vapor of the transfer fluid. The liquid of the transfer fluid is contained in a lower part 5 of the cell. The intermediate stage 1 is supplied with transfer fluid vapor from the stage 2 of one lower rank, with the vapor being compressed and superheated after passing through a compressor 6. The intermediate stage 1 is also fed with transfer fluid liquid from the upper stage 3 through a tubing having a stopcock (not shown) and a plurality of calibrated orifices 8 through which the liquid flashed. Finally, a working fluid circuit having a heat exchange core 9 crosses the intermediate stage 1.

The heat given up by the working fluid has been used to vaporize the incoming liquid and is available in the output vapor at the temperature level of the last stage in the form of latent heat of condensation.

Figure 2:
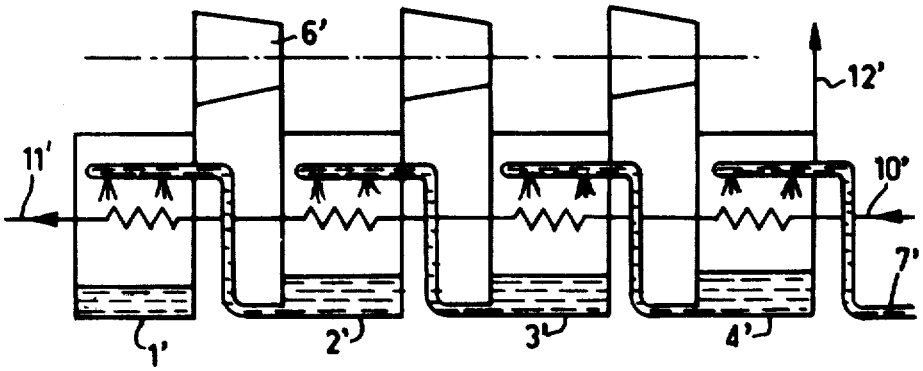
FIG. 2 is a schematic illustration of a series of compressor stages with heat being supplied to the stages.

With reference now to FIG. 2, a sequence of heated cells 1', 2', 3', 4' is arranged with cell pressures and temperatures increasing left to right. The stages are designed as are those of FIG. 1 with the compressor 6' positioned between adjacent cells. The heated cells 1', 2', 3', 4' are crossed in series by a working fluid circuit 10' that is delivering heat to the cells while circulating working fluid in the direction of decreasing cell rank. The transfer fluid vapor ascends the stages in the direction of increasing cell rank; the transfer fluid liquid descends the stages in the direction of decreasing cell rank. The first stage 1' does not have a compressor and all of the transfer liquid reaching that stage is completely vaporized therein.

The stage of highest rank, 4' in such a sequence includes an intake for liquid transfer fluid, an outlet for transfer fluid vapor, and an intake for the working fluid. The cell of lowest rank 1', includes an outlet for the working fluid, which traverses all four stages.

The four stages 1', 2', 3' and 4' are crossed by: (a) a transfer fluid vapor flow which circulates in series in the four stages in the sense of increasing rank; (b) a transfer fluid liquid which circulates in series in the four stages in the sense of decreasing rank; and (c) a working fluid circuit which enters at 10' and leaves at 11', and passes in series through the four stages in the sense of decreasing rank.

To summarize, a sequence of heated stages is thoroughly crossed by the working fluid circuit circulating in the direction of decreasing ranks. The transfer fluid vapor is exhausted at 12' of stage 4', which has a higher pressure and temperature than any other stage; and, liquid transfer fluid is taken into the cell at 7' with a mass flow rate equivalent to that of the exhausted vapor at 12'.

Figure 3:
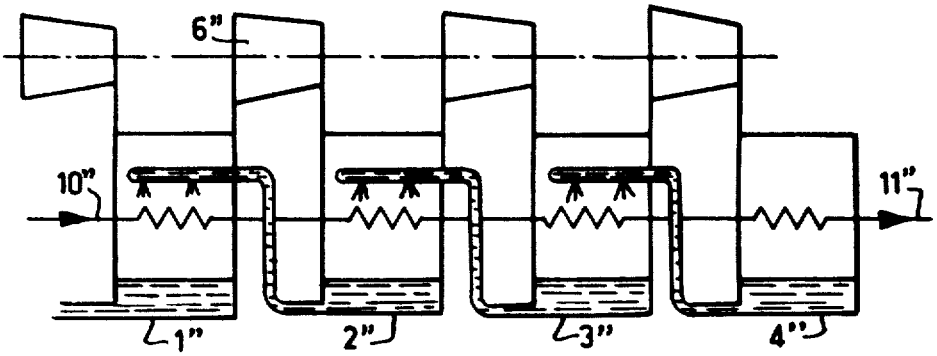
FIG. 3 is a schematic illustration of a series of compressor stages with heat being withdrawn from the stages.

Referring now to FIG. 3, a sequence of cooled cells is serially crossed by a working fluid which withdraws heat from the cells and circulates in the sense of increasing rank. The vapor flow rate ascending the stages in the direction of increasing cell rank is always decreasing. The liquid flow rate descending the stages, in the sense of decreasing cell rank, is always increasing. In the limit all transfer fluid vapor reaching the highest rank cell is entirely condensed.

The first cell of the sequence of cells includes an intake for the transfer fluid vapor, an exhaust for the transfer fluid liquid at the same mass rate as the intake, and an intake for the working fluid. The highest-rank cell has an exhaust for the working fluid. Since there is no exhaust for the transfer fluid vapor from the highest-rank cell, the heat delivered by the transfer fluid vapor has been used to heat the working fluid to the temperature of the highest-rank cell.

With continued reference to FIG. 3, four stages 1'', 2'', 3'' and 4'' have a compressor 6'' associated therewith. A working fluid circuit enters the stage 1'' at 10'' and leaves stage 4'' at 11'' at the highest pressure and temperature. The vapor and liquid flows of the transfer fluid circulate in the same manner as in FIG. 2. The highest ranked stage 4'' is special because it lacks both an input for the transfer fluid liquid and a transfer fluid vapor exhaust. Furthermore, the stage 4'' is special because all of the vapor flow is condensed. To summarize, in a cooled sequence the cells are crossed from end to end by the working fluid circuit with the working fluid circulating in the sense of increasing temperatures. At the lowest ranked stage (i.e., of lowest pressure and temperature), the mass flow rate of transfer fluid vapor taken in is equal to the mass flow rate of liquid exhausted.

A sequence of stages which is not crossed by a heat-carrying circuit is called an "adiabatic sequence." In an adiabatic sequence, a vapor flow enters at the level of the lowest temperature stage. At the level of highest pressure/temperature cell, transfer fluid vapor is exhausted simultaneously with an intake of transfer fluid liquid at the same mass flow rate, the flow rates of liquid and vapor being greater in the highest ranking cell than in the lowest ranking cell.

To transfer heat from a cool working fluid circuit at a temperature between temperatures $T_o$ and $T_1$ to another warmer working fluid circuit which is at a temperature between temperatures $T_2$ and $T_3$, with the average of the latter temperatures being higher, two cell sequences are combined. One of the cell sequences is heated, and the other cell sequence is cooled, according to one of the following modes.

If the temperatures are related such that $$T_o<T_1<T_2<T_3,$$

a sequence of heated stages operating between $T_o$ and $T_1$ is combined both with a sequence of adiabatic stages operating between $T_1$ and $T_2$ and with a sequence of cooled stages operating between $T_2$ and $T_3$. Both the vapor and the liquid transfer fluid circuits are placed in series at the level of the interfaces between the sequences of heating and cooling at temperatures $T_1$ and $T_2$.

Figure 4:
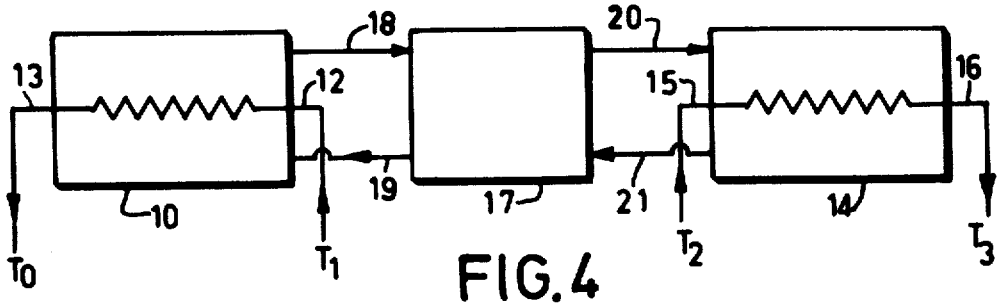
FIG. 4 is a schematic illustration of equipment including a plurality of connected cells which are serially heated and cooled under specific temperature conditions.

With reference to FIG. 4, a schematic of equipment according to this mode includes three cells 10, 14 and 17. A heated sequence 10 is crossed by a working fluid circuit entering the sequence at temperature $T_1$ at 12 and leaving the sequence 10 at temperature $T_o$ at 13. A cooled sequence 14 is crossed by a working fluid circuit entering at temperature $T_2$ at 15 and leaving at temperature $T_3$ at 16. An adiabatic sequence 17 is provided between the heated and cooled sequences. The three sequences are serially crossed by a vapor flow and by a liquid flow of the transfer fluid which passes between the heated sequence 10 and the adiabatic sequence 17 through conduits 18, 19. The vapor flow and the liquid flow pass between the adiabatic sequence 17 and the cooled sequence 14 through conduits 20, 21.

Figure 5:
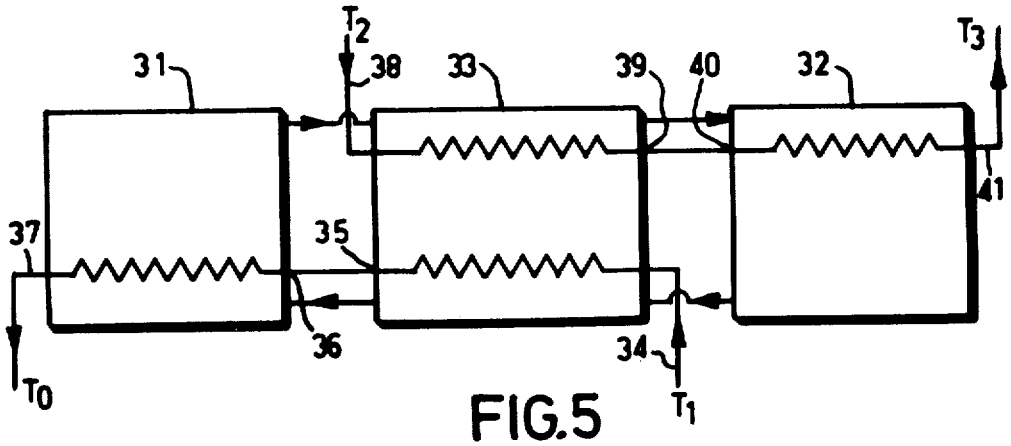
FIG. 5 is a schematic illustration of equipment including a plurality of connected cells which are serially heated and cooled under other specific temperature conditions.

If the temperatures are related as follows:

$$T_o<T_2<T_1<T_3,$$

the two heat-carrying circuits overlap in a common temperature range $T_2$ to $T_1$ (see FIG. 5). In such a situation, a portion of the sequence of heated stages operating between $T_o$ and $T_1$ is crossed at the same time by both heating and cooling working fluid circuits which thus overlap in the temperature range $T_2$ to $T_1$. The sequence of heated stages is combined with a sequence of cooled stages operating between $T_2$ and $T_3$. The sequence of both the vapor and liquid circuits of the transfer fluid are placed in series at the levels of the interfaces between the sequences of different kinds at the temperatures $T_2$ and $T_1$. Furthermore, the segments of heating working fluid circuits are combined with the segments of the cooling circuits in the sequence between $T_1$ and $T_2$.

The schematic of equipment according to this mode includes a heated sequence 31, having temperatures $T_o$ and $T_2$ for the coldest and hottest cells of the sequence respectively. A cooled sequence 32 has temperatures $T_1$ and $T_3$ for the coldest and hottest cells respectively. An intermediary sequence 33 is provided between the heated and cooled sequences. A working fluid circuit enters the intermediary sequence 33 at 34 and leaves it at 35 at a temperature which is slightly higher than $T_2$. The working fluid circuit then enters the heated sequence 31 at 36 at the same temperature. The working fluid circuit leaves the cell 31 at 37 at a temperature $T_o$. A cooling circuit enters the intermediary sequence 33 at 38 at a temperature $T_2$ and leaves the sequence 33 at 39 at a temperature slightly less than $T_1$. The cooling circuit enters the heated sequence 32 at the same temperature at 40 and leaves the cell at 41 at a temperature $T_3$.

The vapor and liquid circuits of the transfer fluid serially cross the three sequences as described in connection with the sequences of FIG. 4.

In regard to the equipment described above in relation to FIGS. 4 and 5, provision is made for combining compressor impellers with the succeeding stages by fixing the impellers either on a single shaft or on several shafts. Furthermore, the heat exchange cores are extended in a restricted number of neighboring cells (for instance two or three) on the side of the higher pressure and temperatures at the level of the intake of the heating fluid and are extended in a number of cells at the side of the lower pressure and temperatures at the level of the intake cooling fluid. Valves are provided in several cells adjacent to those required to be operating nominally at temperatures $T_1$ and $T_2$ and in cells on either side of them. The valves permit either heating or cooling fluids to be introduced into cells at temperatures nearest $T_1'$ and $T_2'$ when fluids arrive from the outside at the non-reference temperature levels $T_1'$ and $T_2'$, (different from $T_1$ and $T_2$).

The object of the present invention is to provide a method and equipment for exchanging heat between a plurality of working fluid circuits which are delivering or removing heat in any mode. For example, the working fluid circuits may carry fluids either at constant temperatures, or between discrete temperature ranges.

Figure 6:
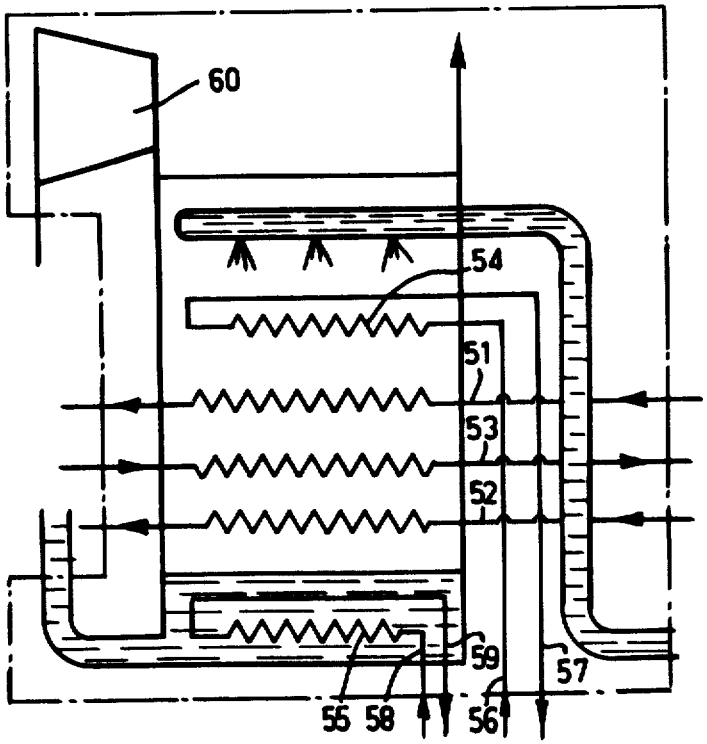
FIG. 6 is a schematic illustration of a generalized stage of a compressor system according to the present invention.

With reference to FIG. 6, equipment of a most generalized stage is illustrated. Operation of the stage of FIG. 6 is similar with respect to the circulation of the vapor and the liquid transfer fluid to operation of the equipment previously described and illustrated. The most generalized stage includes a cell having a compressor 60. The cell further includes a plurality of working fluid circuits for circulating a fluid having temperature dependent heat. The circuits include heat exchange cores 51, 52 which circulate in the direction of decreasing rank and deliver heat to the cell. A circuit 52 circulates in the opposite direction (which is the direction of increasing rank) and removes heat from the cell. Working fluid or heat exchanging circuits for latent heat are provided for the cell and include a heat exchange core 54. The core 54 may simultaneously serve as a condenser for the transfer fluid and as a boiler for an evaporable fluid arriving in liquid form at 56 and leaving as vapor at 57. Another working fluid or heat exchanging circuit 55 serves as a boiler for the transfer fluid liquid and as a condenser for a fluid arriving in vapor form at 58 and leaving as a liquid at 59.

All of the working fluid circuits of the cell use the transfer fluid to exchange heat. If the enthalpy balance of the stage is such that the set of working fluid circuits delivers heat which, together with the compressor's work, exceeds the heat removed from the set of working fluid circuits, the surplus of heat will cause vaporization of the transfer fluid. The amount of heat released in vaporization and carried by the vapor of the transfer fluid is moved by the compressors towards the stages of higher-rank where the vapor will be put to use. If on the other hand, the enthalpy balance is such as to create a shortage of heat in the exchanges, sufficient additional heat in the amount of such shortage will be obtained from condensation of the transfer fluid vapor. The vapor supplying the additional heat has been generated from heat surpluses in the exchanges taking place in the lower-rank stages. Accordingly, the heat surpluses will have been used up in the present stage.

Figure 7:
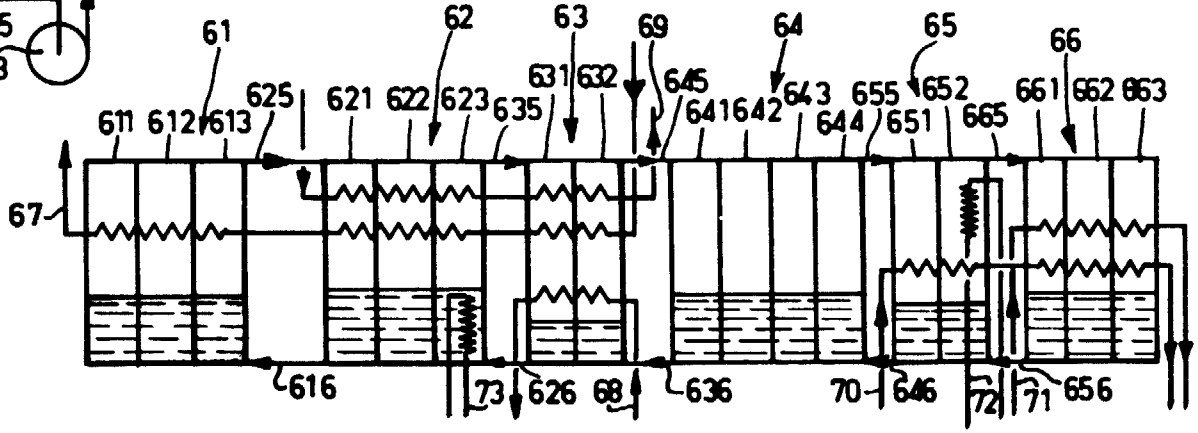
FIG. 7 is a schematic illustration of a compressor system having a plurality of working fluid circuits according to the present invention.

With reference now to FIG. 7, equipment or apparatus according to the present invention may include an arbitrary number of working fluid circuits. A plurality of sets of serially arranged sequences are each crossed by a given number of working fluid circuits. Six sequences numbered from 61 to 66 are arranged in order of temperature levels, with each sequence comprising a given number of stages as follows: sequence 61 includes three stages numbered 611, 612, 613; sequence 62 includes three stages numbered 621, 622, 623; sequence 63 includes two stages numbered 631, 632; sequence 64 includes four stages numbered 641, 642, 643, 644; sequence 65 includes two stages 651, 652; and sequence 66 includes three stages 661, 662, 663. Other sequences are placed in series with the vapor and liquid circuits of the transfer fluid. The vapor of the transfer fluid successively passes from the sequence 61 to 62, 62 to 63, 63 to 64, 64 to 65, and 65 to 66 respectively through tubings 625, 635, 645, 655, 665, while the liquid of the transfer fluid successively passes from sequences 66 to 65, 65 to 64, 64 to 63, 63 to 62, and 62 to 61 respectively through tubings 656, 646, 636, 626, 616.

The equipment includes two working fluid circuits 67 and 68 which circulate a fluid having temperature dependent heat that circulates in the direction of decreasing rank for heating. Three other working fluid circuits 69, 70, 71 circulate a fluid having temperature dependent heat in the direction of increasing rank for cooling. A heat exchanging circuit 72 circulates a fluid having latent heat for cooling and serves as a condensor for transfer fluid. A heat exchanging circuit 73 circulates a fluid having latent heat for heating and serves as a transfer fluid boiler. The sequence 61 is crossed by the working fluid circuit 67 and the sequence 62 is crossed by the working fluid circuits 67 and 69 with the stage 623 of the sequence 62 being further crossed by the working fluid circuit 73. The sequence 63 is crossed by the working fluid circuits 67, 68 and 69. The sequence 64 is not crossed by any working fluid circuits. The sequence 65 is crossed by the working fluid circuit 70 with the stage 652 of the sequence being additionally crossed by the working fluid circuit 72. The sequence 66 is crossed by the working fluid circuits 70 and 71. The stages 623 and 652 are respectively crossed by the working fluid circuits 73 and 72.

All of the liquid arriving from the transfer fluid is vaporized in stage 611.

All of the vapor arriving from the transfer fluid is condensed in stage 663.

If it is desired to combine several circuits according to the present invention having predetermined fluid flows of a temperature dependent or latent heat fluid in their circuits, with each circuit being specified by the flow rates for the working fluid and by the intake and exhaust temperatures, special measures must be taken. In the first place, the heat delivered to the entire equipment plus the work supplied by the compressors must be precisely equal to the heat which is removed from the equipment.

What follows below is a simple formulation referring to ideal equipment having only reversible operations. Such machinery includes an infinite number of stages having compressors of perfect efficiency and with all heat exchanges occurring at zero temperature differences.

An arbitrary stage of such ideal equipment is crossed by a given number of temperature dependent working fluid circuits having mass flow rates of $\dot{m}_1, \dot{m}_2, \ldots \dot{m}_n$ and heat capacities $C_1, C_2, \ldots C_n$. The $\dot{m}_1$ will be considered to be positive when moving toward lower temperatures, and negative when moving toward increasing temperatures. Let $$G = \Sigma \dot{m}_i C_i$$

Since all of the working fluid circuits are within a temperature range from $T_o$ to $T_N$, the entire temperature range of the equipment may be divided into temperature intervals $(T_o, T_1), \ldots (T_i, T_{i+1}), \ldots, (T_{N-1} \ldots T_N)$ with the working fluid circuits remaining the same. In the stage sequence corresponding to an arbitrary interval $(T_i, T_{i+1})$, G remains constant and is equal to $G_{i,i+1}$. Let $\dot{m}_i$ and $\dot{m}_{i+1}$ respectively be the transfer fluid flows entering and leaving this sequence, and let $L_i$ and $L_{i+1}$ be the latent heats of vaporization of the transfer fluid at $T_i$ and $T_{i+1}$. It can be shown that for such a sequence which is assumed to be without a latent working fluid circuit, the following relations obtains, $$\frac{\dot{m}_{i+1} L_{i+1}}{T_{i+1}} = \frac{\dot{m}_i L_i}{T_i}, \; G_{i,i+1} \text{Log } T_{i+1}/T_i$$

For several serially arranged sequences numbered as $\alpha, \alpha+1, \ldots, k, k+1, \ldots \beta-1, \beta$, one may write:

$$\frac{\dot{m}_\beta L_\beta}{T_\beta} = \frac{\dot{m}_\alpha L_\alpha}{T_\alpha} + \Sigma_\alpha^\beta G_{k,k+1} \text{Log} \frac{T_{k+1}}{T_k}$$

If these serially arranged sequences furthermore include latent working fluid circuits at the stages of temperature $T_j$ and characterized by the introduction of a fluid flow rate $\Delta\dot{m}_j$, which is considered positive if for vapor flow and negative if for liquid flow, one may write:

$$\frac{\dot{m}_\beta L_\beta}{T_\beta} = \frac{\dot{m}_\alpha L_\alpha}{T_\alpha} + \Sigma_\alpha^\beta G_{k,k+1} \text{Log} \frac{T_{k+1}}{T_k} + \Sigma \frac{\Delta\dot{m}_j L_j}{T_j}$$

In regard to the entire set of n sequences of the equipment, it must follow that:

$$\Sigma_1^n G_{i,i+1} \text{Log} \frac{T_{i+1}}{T_i} + \Sigma_1^n \frac{\Delta\dot{m}_j L_j}{T_j} = 0$$

This equality is true for the magnitudes relating to the definition of the working fluid circuits described above. In general, for a given set of working fluid circuits, the equality above is not obtained unconditionally a priori, and instead is of the form:

$$\Sigma_1^n G_{i,i+1} \text{Log} \frac{T_{i+1}}{T_i} + \Sigma_1^n \frac{\Delta\dot{m}_j L_j}{T_j} = A$$

According to the invention, therefore, additional heating or cooling is delivered to the equipment by means of working fluid circuits which may supply: (a) temperature dependent working fluids characterized by the values $G_{m,m+1}$ and by temperatures $T_{m,m+1}$; or (b) latent heat working fluids characterised by flow rates $\Delta\dot{q}_l$, by temperatures $T_l$, and by latent heats of vaporization $L_l$ such that:

$$\Sigma_1^n G_{n,m+1} \text{Log} \frac{T_{m+1}}{T_m} + \Sigma_1^n \Delta\dot{q}_l \frac{L_l}{T_l} = -A$$

Thus, the invention allows one to balance the heat exchanges in the equipment in an infinite number of ways depending only on one degree of freedom. For example, without thereby implying restriction, if there is a heat source consisting of a temperature dependent working fluid between the temperatures $T_a$ and $T_b$, it will be feasible to introduce into the machinery an additional working fluid circuit which circulates a flow adjusted so that $$G_{a,b} \text{Log } (T_b/T_a) = -A$$

If there is a latent heat source at temperature $T_c$, it will be feasible to introduce a working fluid circuit into the cell at the same temperature and at a flow rate $\Delta\dot{q}_c$, so that $$\Delta\dot{q}_c L_c/T_c = -A.$$

It will be noted that these results remain qualitatively valid for actual equipment having a finite number of stages, real compressors, and heat exchanges occurring at temperature differences other than zero. In the non-ideal case, however, the working fluid circuits are introduced into the stage so as to obtain an exchange-temperature difference in the desired direction between the temperatures of the fluids and the temperatures of the stages.

It will be furthermore noted that in the case of ideal equipment, the flow rate of the fluid leaving a stage of arbitrary rank is equal to:

$$\dot{m}_\gamma = \frac{T_\gamma}{L_\gamma} \left[ \Sigma_1^\gamma G_{i,i+1} \text{Log} \frac{T_{i+1}}{T_i} + \Sigma_1^\gamma \Delta\dot{m}_j \frac{L_j}{T_j} \right]$$

The value $\dot{m}_\gamma$ assumes physical sense only when positive. The equation implies that the balance in mass between both the liquid flows, which are vaporized by excess heat intervening in the exchanges and implemented in the low temperature stages and the vapor flows which are condensed due to lack of heat in the same stages, is positive. If such a balance were to pass through zero and become negative, it would follow that there is high-level heat in the given working circuits and that this high-level heat would have to be made to descend toward the lower temperatures to again balance the exchanges.

It will be noted that these results are also qualitatively valid for actual equipment. The positive mass flow rate, which actually determines the application limits of the process, shall be called the "condition of applicability for compressor systems." The term "compressor system" represents a complete set of compressors such as was described above.

In another regard, the invention also applies to equipment including working fluid circuits when the heat exchanges introduce an imbalance as a result of a high temperature excess and a low temperature deficiency.

In such a case, heat exchanges are achieved in a sequence of stages of different pressure/temperatures between, on one hand, a vapor of a transfer fluid in the presence of its liquid, and on the other hand temperature dependent working fluids circulating in heat exchange cores that pass serially through cells. Each of the cells is fed from the "following" cell, (that is, a cell of the next higher rank) with a flow rate of condensable fluid expanding from the pressure of the following cell to that of the present cell. The present cell delivers to the following cell a mass flow of the transfer fluid of the same magnitude in liquid form by means of a pump. The heat exchanges take place within the cell between, on one hand, the transfer fluid flows crossing the cell both as vapor and liquid, and on the other hand, between the different temperature dependent working fluids, circulating both in the direction of decreasing rank and delivering heat to the cell, and circulating in the sense of increasing rank and removing heat from the cell. The difference between the supply and removal of heat to and from the cell gives rise to an exchange of mass between the liquid and vapor circuits of the transfer fluid. A net generation of vapor will result if the difference amounts to an overall delivery of heat. A net condensation of vapor will result if the difference amounts to an overall removal of heat. Thus, if the net balance of the heat exchanges in the stage under consideration results in excess heat, the excess may be stored in the form of latent heat and moved toward the low pressure/temperature stages for consumption. Similarly, if the exchanges result in a shortage of heat, the shortage in the absence of any other action may be compensated by condensation from the heat contained in the vapor that was generated from the excess heat in the higher-rank stages.

Figure 8:
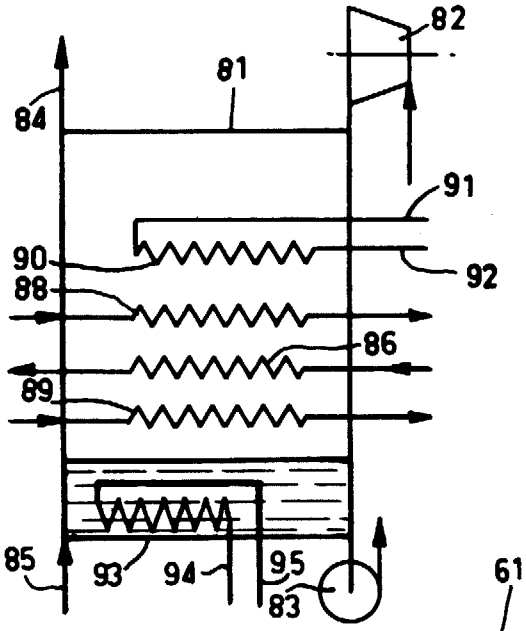
FIG. 8 is a schematic illustration of a generalized stage of a turbine system according to the present invention.

The expansion of the vapor flow from one stage to the next may be achieved in accordance with the present invention by using a turbine. The turbine rotors are arranged with respect to the different stages and may be fixed on one or several shafts if desired. A most general stage of the equipment including a turbine is described with reference to FIG. 8.

An exchange cell 81 is filled in its upper part with transfer fluid vapor and in its lower part with transfer fluid liquid. The cell is supplied with a flow of transfer fluid vapor by means of a turbine 82 from a stage of next higher rank. In turn the cell delivers the same amount of transfer fluid in liquid form back to the stage of next higher rank by means of a pump 83. The transfer fluid vapor passes to a stage of next lower-rank by means of a tubing 84. The cell 81 received the transfer fluid from the lower-rank stage through a tubing 85.

The cell 81 is crossed by a temperature dependent working fluid circuit including heat exchange cores such as 86, which circulate fluid in the direction of decreasing rank while delivering heat. The cell is also crossed by temperature dependent working fluid circuits such as 88 and 89 which circulate in the direction of increasing rank and remove heat.

Latent heat exchanging circuits cross the cell and include heat exchange cores such as 90 which serve as a condensing core for the transfer fluid and as a boiler for an evaporable fluid that arrives in the boiler in liquid form at 91 and leaves as vapor at 92. Another latent heat exchanging circuit serves as a boiler for the transfer fluid and as a condensor for a condensable fluid arriving as vapor at 94 and leaving as liquid at 95.

Figure 9:
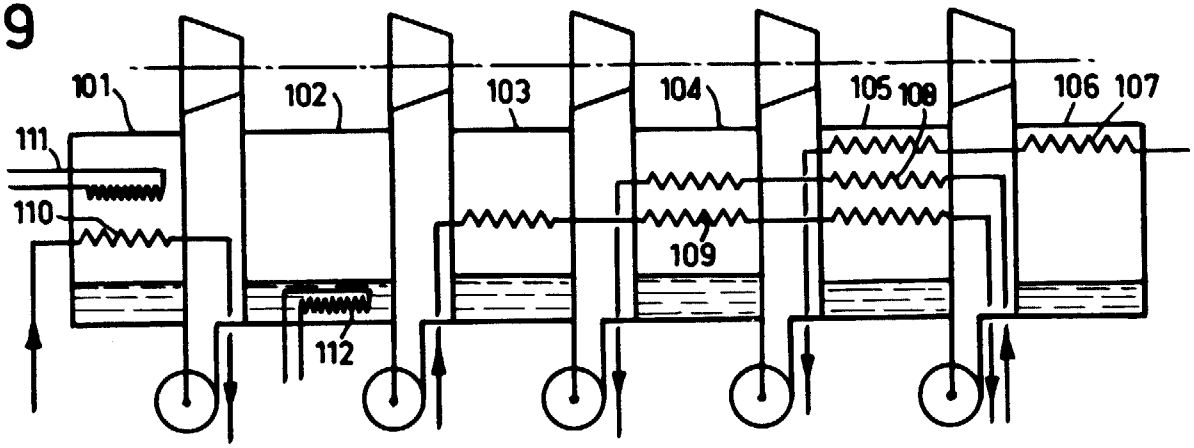
FIG. 9 is a schematic illustration of a turbine system having a plurality of working fluid circuits according to the present invention.

With reference now to FIG. 9, a turbine system according to the present invention includes an arbitrary number of working fluid circuits. The turbine system includes a series of stages arranged in increasing order of pressures/temperatures and numbered from 101 to 106. A pair of temperatures dependent working fluid circuits 107 and 108 circulate in the direction of decreasing rank and supply heat to the respective cells. A pair of temperature dependent working fluid circuits 109 and 110 circulate in the direction of increasing rank and remove heat for cooling. A latent heat exchanging circuit includes a condensing heat exchange core 111. Another latent heat exchanging circuit includes a boiling heat exchange core 112.

All of the incoming vapor is condensed in cell 101 and all of the incoming liquid is vaporized in cell 106. If it is desired to combine several heat circuits according to the present invention, special means must be employed.

In the first place, the amount of heat added to the total heat in the working fluid system must equal the heat which is removed from the total heat plus the sum of the work done by the turbines. Furthermore, one must take into account considerations relating to ideal machinery in which only reversible operations take place.

Using the same notation as for the compressor system, and observing the sign convention below, $m_i > 0$ when the transfer fluid vapor flow circulates toward increasing pressure/temperatures, $m_i < 0$ when the transfer fluid vapor flow circulates toward decreasing pressure/temperatures, it follows that exactly the same formulations apply to the turbine sequences as to the compressor sequences.

It is possible, therefore, to directly reformulate in an analogous manner the results previously obtained.

If one desires to combine a given set of working fluid circuits with each other according to the present invention, it will be generally necessary to add at least one complementary working fluid circuit which is dependent on only one degree of freedom of the equipment.

On the other hand, for any cell it is necessary that the amount of heat added to the overall energy by the heating working fluid circuits to the higher-rank stages exceeds the amount of heat removed from the overall energy in the same stages by the cooling working fluid circuits, plus the total work by the turbines in these stages. This condition shall be termed:

"condition of applicability of the turbine system."

Figure 10:
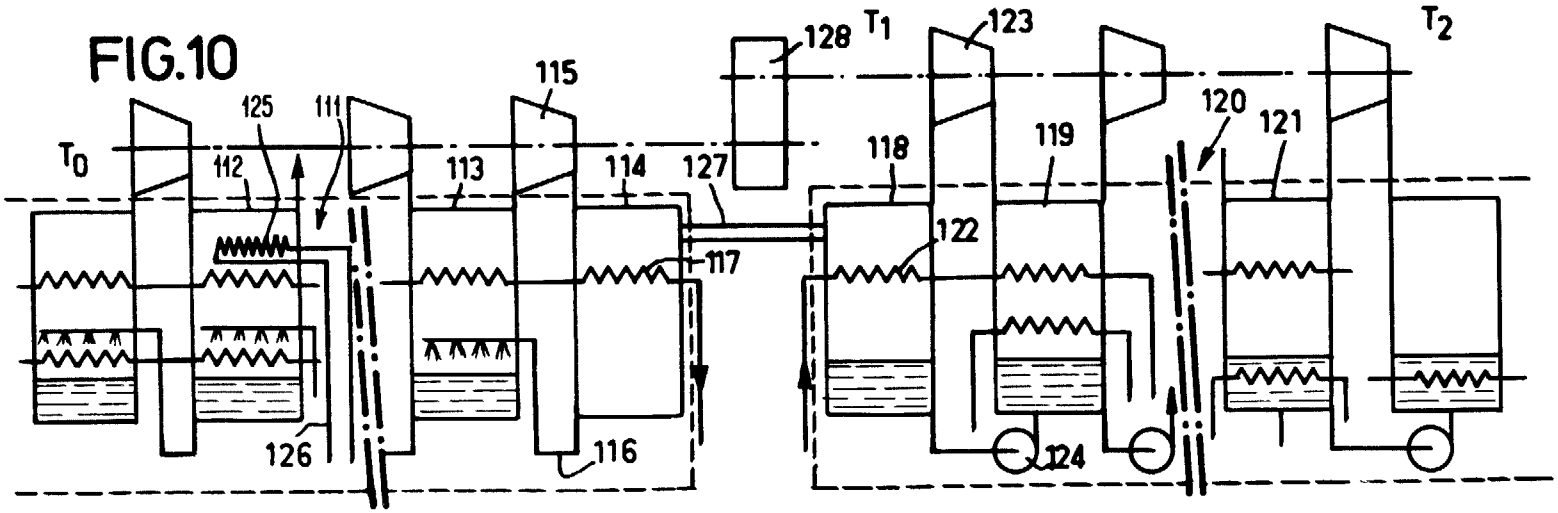
FIG. 10 is a schematic illustration of portions of equipment according to the present invention including both a compressor system and a turbine system which are coupled together.

With reference now to FIG. 10, the most generalized form of the present invention makes use of both compressor systems and turbine systems operating in temperature intervals $(T_o, T_1)$, $T_1, T_2) \ldots (T_{N-1}, T_N)$ within which temperature intervals will be satisfied both the conditions for the compressor systems and for the turbine systems as defined above.

As noted above, the cells of adjacent stages of two stages of different kind may be combined to form a single cell.

Again it is possible to join the segments of a given working fluid circuit crossing two adjacent sequences. It will be noted in this regard that when considering the overall problem implemented only by ideal machinery, it is know that both for compressor systems and for turbine systems, the following expression describes the transfer fluid flow rate from a cell of rank $\gamma$:

$$\dot{m}_\gamma = \frac{T_\gamma}{L_\gamma}\left[\Sigma_1^\gamma G_{i,i+1} \operatorname{Log}\frac{T_{i+1}}{T_i} + \Sigma_1^\gamma \frac{\Delta \dot{m}_i L_i}{T_i}\right]$$

where $\dot{m}_\gamma$ is positive and negative in the compressor and turbine cells respectively.

The temperature intervals within which are located either the compressor or the turbine equipment are, therefore, defined respectively by $$\dot{m}_\gamma > 0,\ \dot{m}_\gamma < 0.$$

On the other hand, the conditions to be satisfied by the additional working fluid circuits which are to be combined with the equipment so as to balance the heat exchanges can be expressed for the entire temperature interval ($T_o$, $T_N$).

Assuming that the present working fluid circuits are such that:

$$A = \Sigma_1^n G_{i,i+1} \operatorname{Log}\frac{T_{i+1}}{T_i} + \Sigma_1^n \frac{\Delta \dot{m}_i L_i}{T_i}$$

then the addition working fluid circuits must satisfy:

$$-A = \Sigma_1^n G_{m,m+1} \operatorname{Log}\frac{T_{m+1}}{T_m} + \Sigma_1^n \Delta \dot{q}\frac{L_1}{T_1}$$

The delivery of complementary heat to balance the heat exchanges in the entire range ($T_O$, $T_N$) may be implemented by a single working fluid circuit and involves only one degree of freedom.

It should be noted that the above proposition, which has been proven for ideal systems, is also valid for real systems.

If one chooses to deliver the complementary heat in the form of a vapor condensing at a fixed temperature (corresponding to the saturation pressure), the heat exchange core of the working fluid circuit must be located in the cell in which the operational temperature is essentially equal to the fixed temperature of the vapor. Adjustment of the system will then be carried out by means of the fluid flow of the condensing vapor.

Similarly, if in order to achieve thermodynamic equilibrium, heat must be removed, recourse may be had to a liquid at a temperature near its boiling point, which will be made to boil in a heat exchange core located in a cell at that temperature.

If one desires to deliver or remove the complementary heat by a working liquid operating in a fairly large temperature range, the heat exchange cores must be located over the entire set of cells corresponding to said range and must be crossed in the proper sense.

With continued reference to FIG. 10, equipment according to the present invention includes both compressor and turbine systems which have been coupled together.

Two stages of higher rank of a compressor sequence 111 communicate between themselves by means of a compressor 115 and a tubing 116. The tubing 116 supplies liquid from a cell 114 which flashes in the cell 113. An arbitrary stage 112 of rank is also shown. The last stages of the compressor sequence 111 are crossed for example by cooling bundles 117. The sequence 111 operates between temperatures $T_o$ and $T_1$.

Two stages of lower rank of a turbine sequence 120 operating between temperatures $T_1$ and $T_2$ are shown at 118 and 119. An arbitrary stage of rank j is also shown at 121. The two lower stages 118, 119 are crossed for example by a cooling bundle 122, with the cells communicating between themselves through a turbine 123 and a pump 124.

In order to achieve thermodynamic equilibrium in the overall equipment, a liquid which boils at a temperature near the temperature prevailing in cell 112 is utilized. The liquid circulates in a heat exchange core bundle 125 with its flow being controlled by a valve provided in a conduit 126. The work fluids are assumed to be identical in both the compressor sequence 111 and in the turbine sequence 120. A tubing having a suitable-cross section is located between the atmospheres of cells 114 to 118 to provide communication between the cells.

It is understood that the control of the valve of the conduit 126 may be made conditional on data provided by a computer based on the flows of the various working fluids taking place in the two sequences and also on the basis of the cell temperatures and the transfer fluid flows. Because of the communication of the two atmospheres of the end cells 114 and 118 of systems 111 and 120 by the tubing 127, it is possible to achieve a rigorous balance of temperature at $T_1$, because in each cell the liquid is in the presence of the vapor. The junction provided by the tubing 126 may be replaced by combining the two cells 114 and 118 into a single cell.

Finally, the shafts which are common to all the compressors of the compressor system 111 and the shafts which are common to all the turbines of turbine system 120 are mechanically coupled together or interconnected by a coupling 128. The coupling 128 may include a motor for starting the compressors and turbines and for supplying and removing energy from the system.

The cooling bundles 117 and 122 located in cells 114 and 118 are assumed to be separated in FIG. 10. If the cooling circuits are transmitting fluids of the same kind and at the same flow rate, then the two cooling circuits may be joined together.

The quipment described above and illustrated in part in FIG. 10 represents, however, only one of the many special arrangements which are possible and are encompassed by the present invention.

According to the present invention, any fluid providing an easy transport of heat may be used as the transfer fluid. Such fluids include but are not limited to ammonia, methanol, ethanol, the Freons, carbon tetrachloride $CCl_4$, carbon disulfide $CS_2$, ethylic ether, benzene, and even water. The heat-carrying fluids may be arbitrarily selected and may be fluids that are readily available or otherwise available from any chemical process, whether or not involving a change in energy.

Accordingly, the invention permits the amount of heat and work required to balance the heat exchanges between fluids at different temperatures to be minimized, and, thus, provides an optimum energy balance.

The present invention is applicable to widely varied operations, including industrial heating, industrial processes, urban heating and other heating. Equipment according to the present invention may be used as a heat pump having arbitrary power.

A specific example of equipment according to the present invention includes the following working fluid circuits, (let G = heat capacity) having the following characteristics:

(a) temperature dependent working fluid circuits
- —delivering (5000 kw between 200° C. and 250° C., $G_1 = 100$ kw/°C.
  - (4000 kw between 80° C. and 120° C., $G_2 = 100$ kw/°C.
- —removing (4200 kw between 180° C. and 240° C., $G_1' = -70$ kw/°C.
  - (2800 kw between 170° C. and 210° C., $G_2' = -70$ kw/°C.
  - (600 kw between 110° C. and 150° C., $G_3' = -15$ kw/°C.
  - (3150 kw between 220° C. and 265° C., $G_4' = -70$ kw/°C.

(b) latent-heat exchanging circuits
- —delivering 1731 kw at 265° C.
- —removing 677 kw at 240° C.

Some of the working fluid circuits are part of the processes, others have been added as complements to close the loop of the energy balance so that the overall equipment is balanced.

The table below illustrates the properties of the equipment of the specific example according to the present invention. A schematic illustration of the machinery is provided. The relevant physical values entering this problem at all temperature levels are provided opposite the schematic illustration. The physical values include the heat and work involved at all temperature intervals, the working-fluid flow-rate at the limits of the intervals, etc.

The working fluid used in the equipment of the specific example is water.

The equipment receives, in sum:

9900 kw of heat 779 kw of mechanical energy from the compressor and loses, in sum:

10750 kw of heat 82 kw of mechanical turbine energy.

The input of mechanical energy to the equipment is, therefore, calculated as 779 kw − 82 kw = 697 kw.

Lastly, it will be noted that the transition from the sequence of compressors to the sequence of turbines arises naturally in the computations and at the specific temperature level where the grouping $\dot{m}L/T$ passes through zero and becomes negative.

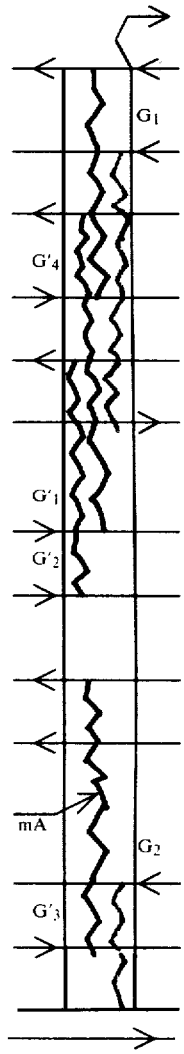

| | ṁ'a | T°k. | G | ṁL/T kg/°C. | ṁL kg/°C. | ṁ kg/s | GΔT kw | W kw |
|---|---|---|---|---|---|---|---|---|
| | | | | | | TURBINES | | |
| 265 | | 538 | | 3.218 | 1731 | 1.06 | | |
| | | | 70 | | | | 1050 | 34 |
| 250 | $G_1$ | 523 | | 1.237 | 642 | 0.37 | | |
| 240 | | 513 | 30 | 1.816 | 932 | 0.53 | 300 | 16.6 |
| | | | 40 | | | | 300 | 21.2 |
| 220 | $G'_4$ | 493 | | 0.224 | 110 | | | |
| 210 | | 483 | 30 | 0.836 | 404 | 0.213 | 300 | 6.4 |
| 200 | | 473 | 40 | 0 | 0 | 0 | 400 | 4 |
| | | | | | | COMPRESSORS | | |
| | | | 140 | | | | 2800 | 60 |
| 180 | $G'_1$ | 453 | | 6.05 | 2740 | 1.459 | | |
| 170 | $G'_2$ | 443 | 70 | 7.61 | 3370 | 1.645 | 700 | 70 |
| | | | 0 | | | | 0 | 151 |
| 150 | | 423 | | 7.61 | 3219 | 1.524 | | |
| 140 | | 413 | 15 | 7.97 | 3290 | 1.535 | 150 | 79 |
| | mA | | | 9.6 | 3967 | 1.851 | | |
| 120 | $G_2$ | 393 | 15 | 10.35 | 4068 | 1.897 | 300 | 202 |
| 110 | $G'_3$ | 383 | 85 | 8.16 | 3125 | 1.402 | 850 | 93 |
| | | | 100 | | | | 3000 | 125 |
| 80 | | 353 | | | | | | |

It is to be understood that the form of embodiment of the invention which has been described above has been given by way of a purely indicative and in no way limiting example. Other modifications may readily be made by one skilled in the art without thereby departing from the scope of the invention.

What is claimed is:

1. Apparatus for exchanging heat with a circuit carrying fluid at a temperature in the range of $T_o$ to $T_N$ with a minimum expenditure of heat and work, comprising:

a plurality of stages arranged in series, each stage operating in a corresponding one of the bounded temperature intervals, $T_o$ to $T_1$, $T_1$ to $T_2$, . . . , or $T_{N-1}$ to $T_N$, the temperature intervals covering all of the range from $T_o$ to $T_N$, the stage operating in the interval $T_o$ to $T_1$, being of lowest rank, the stage operating in the interval $T_{N-1}$ to $T_N$ being of highest rank, and all of the stages operating in the entire range between $T_1$ and $T_{N-1}$ being of intermediate and increasing rank, each stage including at least one cell filled with a transfer fluid present in both liquid and vapor states, each intermediate stage further including first means for providing liquid-state transfer fluid communication between the intermediate stage and an adjacent stage of different rank, this first means including second means for maintaining a pressure differential between the intermediate stage and the next adjacent stage, third means for providing vapor-state transfer fluid communication between the intermediate stage and an adjacent stage of different rank, this third means including fourth means for maintaining a pressure differential between the intermediate stage and the next adjacent stage;

a working fluid circuit means for exchanging heat with the transfer fluid in at least one cell; and heat exchanging circuit means for exchanging heat with the transfer fluid in at least one cell, the heat exchanging circuit means being adjustable for balancing overall thermodynamic equilibrium of the apparatus.

2. The apparatus of claim 1 wherein:

the second means includes an orifice of predetermined size to control liquid state flow to the lower rank stage; and the fourth means is a compressor, the compressor removing vapor from one cell and supplying compressed vapor to the cell of higher stage rank.

3. The apparatus of claim 1 wherein:

the second means includes a pump for advancing liquid to the higher rank stage; and the fourth means includes a turbine driven by vapor passing from one stage to the stage of lower rank.

4. The apparatus of claim 1 wherein:

for one portion of the intermediate stages, the second means includes an orifice of predetermined size to control liquid state flow to the lower rank stage, and the fourth means is a compressor, the compressor removing vapor from one cell and supplying compressed vapor to the cell of higher stage rank; and for another portion of the intermediate stages, the second means includes a pump for advancing liquid to the higher rank stage, and the fourth means includes a turbine driven by vapor passing from one stage to the stage of lower rank.

5. The apparatus of claim 4 wherein all of the compressors and all of the turbines are mechanically intercoupled.

6. The apparatus of claim 4 wherein each stage includes only a single cell.

7. The apparatus of claim 4, wherein the adjustable heat-exchanging circuit means includes only one heat-exchanging circuit, temperature of a fluid circulating in the one circuit being adjusted to balance overall thermodynamic equilibrium of the apparatus.

8. The apparatus of claim 4 wherein the adjustable heat-exchanging circuit means includes only one heat exchanging circuit, flow rate of a fluid circulating in the one circuit being adjusted to balance overall thermodynamic equilibrium of the apparatus.

9. The apparatus of claim 4 wherein the adjustable heat-exchanging circuit means includes only one heat-exchanging circuit, the one circuit supplying heat to the cell by condensing a vapor carried by the one circuit at a fixed temperature, the one circuit having a heat exchange core positioned in the cell of the stage operating in a temperature range which is substantially equal to the fixed temperature, the one heat-exchanging circuit being adjusted by adjusting the flow rate of the vapor through the heat exchange core.

10. The apparatus of claim 4 wherein the adjustable heat-exchanging circuit means includes only one heat-exchanging circuit, the one circuit removing heat from the cell by boiling a liquid carried by the one circuit at a fixed temperature, the one circuit having a heat exchange core positioned in the cell of the stage operating in a temperature range which is substantially equal to the fixed temperature, the one circuit being adjusted by adjusting the flow rate of the liquid through the heat exchange core.

11. The apparatus of claim 4 wherein the adjustable heat-exchanging circuit means includes only one heat-exchanging circuit, the one circuit circulating a liquid through a heat exchanger core extending through cells of stages operating over a temperature range $T_a$ to $T_b$ where $T_a$ and $T_b$ are between $T_0$ and $T_N$, and where the one circuit is adjusted by adjusting the flow rate of the liquid through the heat exchange core.

12. The apparatus of claim 5 further comprising:

motor means for starting the mechanically intercoupled compressors and turbines and for supplying and removing energy for the apparatus, the motor means being mechanically intercoupled to the compressors and turbines.

13. A method of exchanging heat in a balanced system between a plurality of circuits carrying fluids at different temperatures ranging from $T_o$ to $T_N$ with a minimum expenditure of work, comprising the steps of:

providing a plurality of stages arranged in series, each stage operating in a corresponding one of a corresponding plurality of bounded temperature intervals $T_o$ to $T_1$, $T_1$ to $T_2$, . . . $T_{N-1}$ to $T_N$, the temperature intervals covering all of the range from $T_o$ to $T_N$, the stage operating in the interval $T_o$-$T_1$ being of lowest rank, the stages operating in the intervals in the range $T_1$-$T_{N-1}$ being of intermediate rank, and the stage operating in the interval $T_{N-1}$-$T_N$ being of highest rank, each stage including at least one cell communicating with adjacent stages of higher and lower rank for transferring the liquid and vapor between the cells of stages of higher and lower rank;

circulating a transfer fluid as both a liquid and a vapor between the plurality of stages;

maintaining a pressure differential between each pair of adjacent stages;

heating the transfer fluid in at least one cell with at least a first working fluid circuit;

cooling the transfer fluid in at least one cell with at least a second working fluid circuit;

adjusting a fluid flow in a third circuit to control overall thermodynamic equilibrium of the heat exchanges.

14. The method of claim 13 futher comprising the steps of:

compressing transfer-fluid vapor from one stage operating in one temperature interval; and supplying the compressed transfer-fluid vapor to a second stage of next higher rank.

15. The method of claim 14 further comprising the steps of:

driving a turbine with transfer-fluid vapor from a third stage operating in a different temperature interval; and supplying the transfer-fluid vapor exhausted from the turbine to a fourth stage of next lower rank.

16. The method of claim 15 further comprising the steps of:

spraying transfer-fluid liquid into the one stage from the second stage of next higher rank; and pumping the transfer fluid from the fourth stage to the third stage.

17. The method of claim 16 wherein the third circuit is adjusted by regulating temperature of the fluid circulating in the third circuit.

18. The method of claim 16 wherein the third circuit is adjusted by regulating the flow rate of the fluid circulating therein.

19. The method of claim 18 further comprising the steps of:

circulating a vapor at a fixed temperature in the third circuit;

condensing the vapor while it passes through a stage operating in a temperature range substantially equal to the fixed temperature.

20. The method of claim 18 further comprising the steps of:

circulating a liquid at a fixed temperature in the third circuit; and boiling the liquid while it passes through a stage operating in a temperature range substantially equal to the fixed temperature.

21. The method of claim 18, further comprising the step of:

circulating a liquid through the third circuit and through the stages operating over the temperature range $T_A$ to $T_B$, where $T_A$ and $T_B$ are each between $T_o$ and $T_N$.

22. The method of claim 15 further comprising the step of supplying energy to the system by driving the compressor and turbine with a motor.

23. The method of claim 15 further comprising the step of removing energy from the system by driving the motor with the compressor and turbine.

24. The method of claim 15 further comprising the step of intercoupling the compressor and the turbine so as to drive the compressor with the turbine.

* * * * *